US007957891B2

(12) United States Patent
Okuyama et al.

(10) Patent No.: US 7,957,891 B2
(45) Date of Patent: Jun. 7, 2011

(54) ELECTRONIC CONTROL DEVICE FOR REMOTE CONTROL AND TELEOPERATION SYSTEM USING SAME

(75) Inventors: Takashi Okuyama, Shizuoka-ken (JP); Masaru Suzuki, Shizuoka-ken (JP); Syu Akuzawa, Shizuoka-ken (JP); Makoto Ito, Shizuoka-ken (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 1027 days.

(21) Appl. No.: 11/694,630

(22) Filed: Mar. 30, 2007

(65) Prior Publication Data

US 2008/0027598 A1 Jan. 31, 2008

(30) Foreign Application Priority Data

May 22, 2006 (JP) ..... 2006-141630

(51) Int. Cl.
*B63H 21/21* (2006.01)

(52) U.S. Cl. ..... 701/115; 301/71; 439/34; 440/84

(58) Field of Classification Search ..... 310/71; 701/115

See application file for complete search history.

(56) References Cited

U.S. PATENT DOCUMENTS

| | | | | |
|---|---|---|---|---|
| 3,492,556 | A * | 1/1970 | Friend | 318/149 |
| 3,969,614 | A * | 7/1976 | Moyer et al. | 701/103 |
| 5,454,001 | A * | 9/1995 | Nagatani et al. | 714/821 |
| 5,586,118 | A * | 12/1996 | Hashimoto et al. | 370/451 |
| 5,659,702 | A * | 8/1997 | Hashimoto et al. | 709/245 |
| 5,696,904 | A * | 12/1997 | Hashimoto et al. | 709/224 |
| 5,764,919 | A * | 6/1998 | Hashimoto | 709/236 |
| 6,595,811 | B2 * | 7/2003 | Dagenais et al. | 440/1 |
| 7,144,283 | B2 * | 12/2006 | Kawase | 440/84 |
| 7,349,479 | B2 * | 3/2008 | Suganuma et al. | 375/257 |
| 7,442,101 | B2 * | 10/2008 | Kawase et al. | 440/1 |
| 2002/0077007 | A1 * | 6/2002 | Dagenais et al. | 440/1 |
| 2002/0189841 | A1 * | 12/2002 | Patterson | 174/72 A |

FOREIGN PATENT DOCUMENTS

| | | |
|---|---|---|
| JP | 2003-127985 | 5/2003 |
| JP | 2003-146292 | 5/2003 |
| JP | 2003-304265 | 10/2003 |
| JP | 2004-217180 | 8/2004 |
| JP | 2005-254849 | 9/2005 |
| JP | 2005-294352 | 10/2005 |

* cited by examiner

*Primary Examiner* — Shelley Chen
(74) *Attorney, Agent, or Firm* — Keating & Bennett, LLP

(57) ABSTRACT

An ECU for a main remote control has a termination resistance having a first terminal connected to a high level signal line CAN of a CAN cable and a second terminal connected to an external terminal of a connector. The CAN cable also has a low level signal line CAN connected to an external terminal of a connector. A power wire VCC is divided at its midportion, and respectively connected to external terminals of the connector. When a connector is connected, the termination resistance is connected between the high level signal line CAN and the low level signal line CAN of the CAN cable by a jumper line, and power is supplied through a jumper line. When the connector is disconnected, the termination resistance is not connected and the ECU for a main remote control does not operate since no power is supplied thereto.

13 Claims, 9 Drawing Sheets

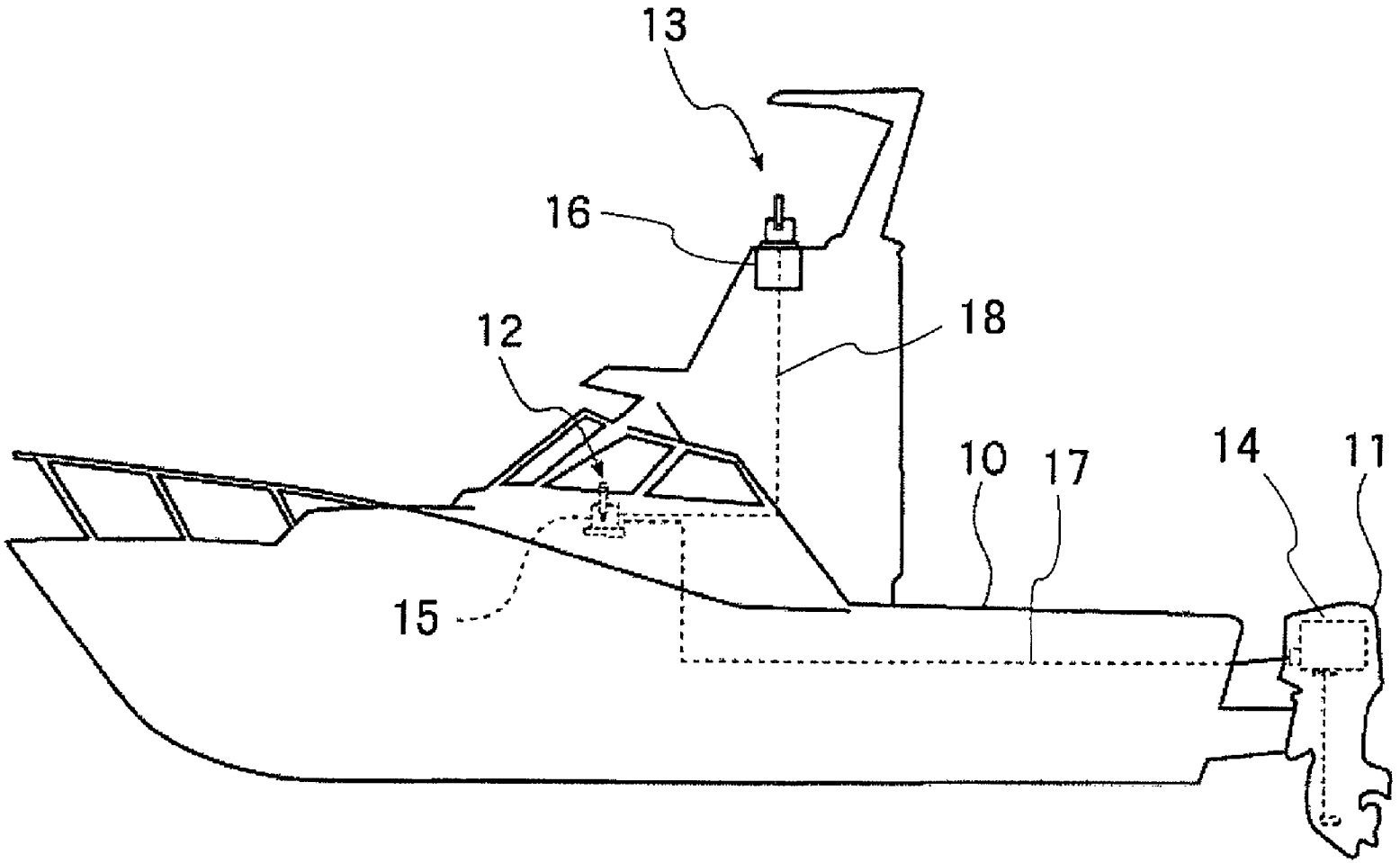
[Fig. 1]

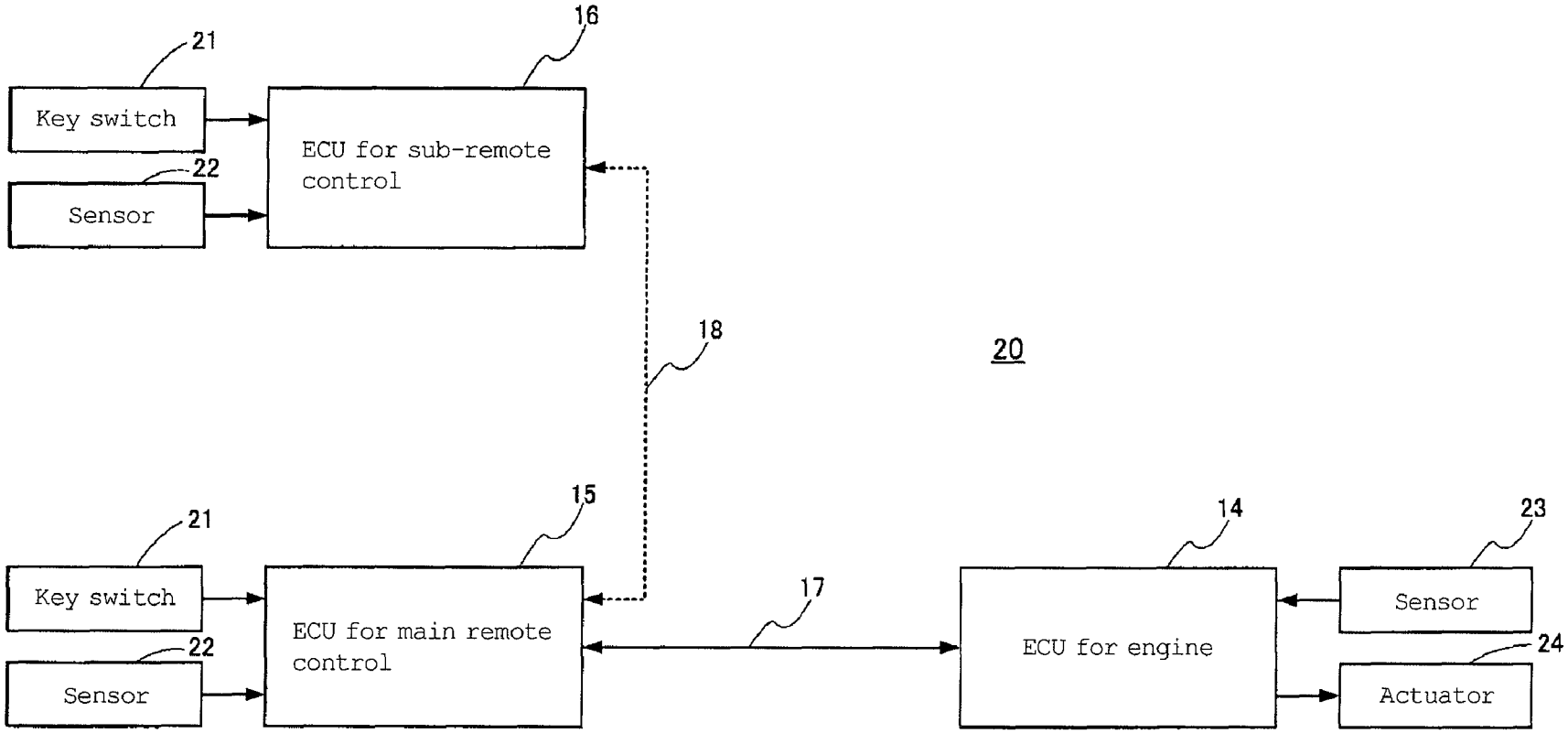
[Fig. 2]

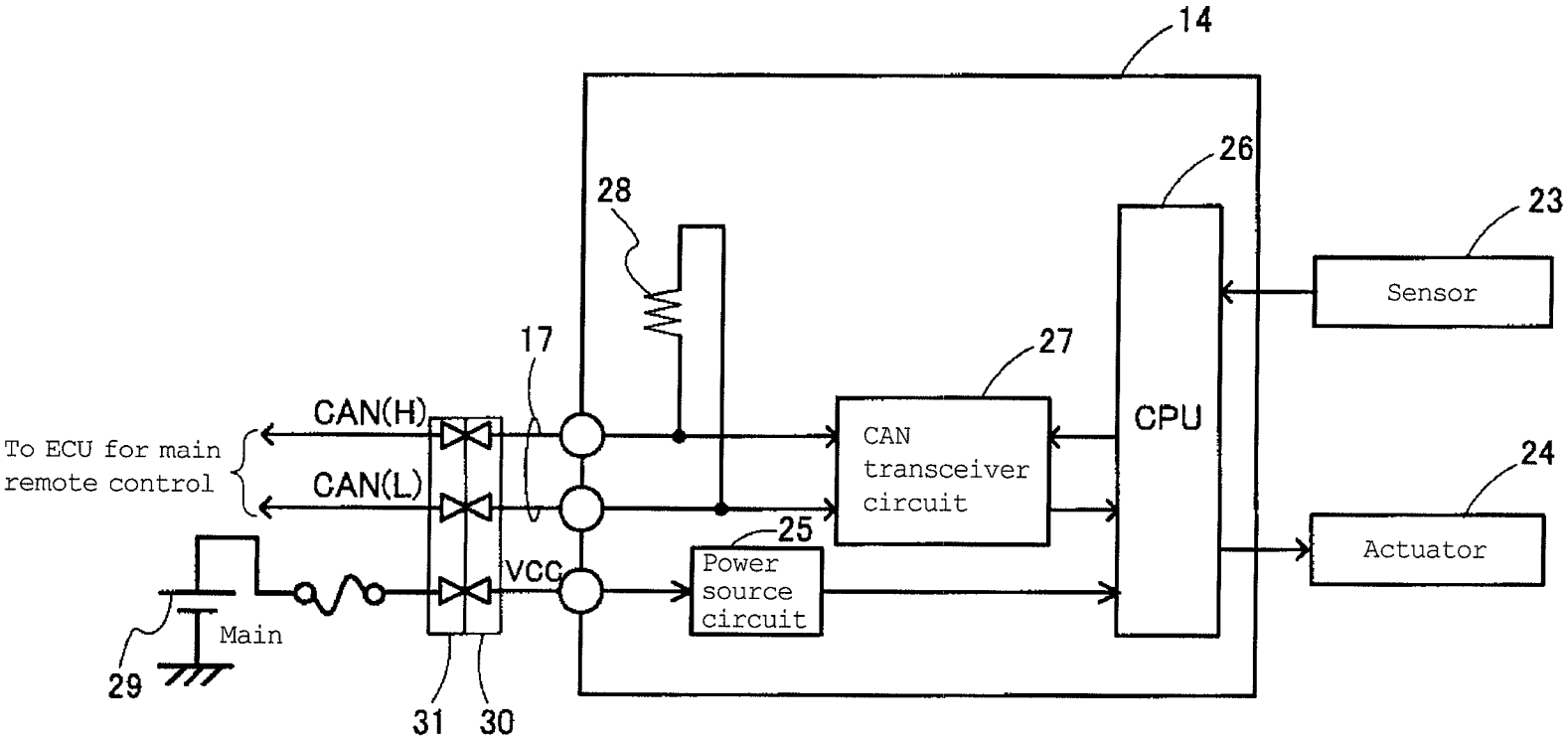
[Fig. 3]

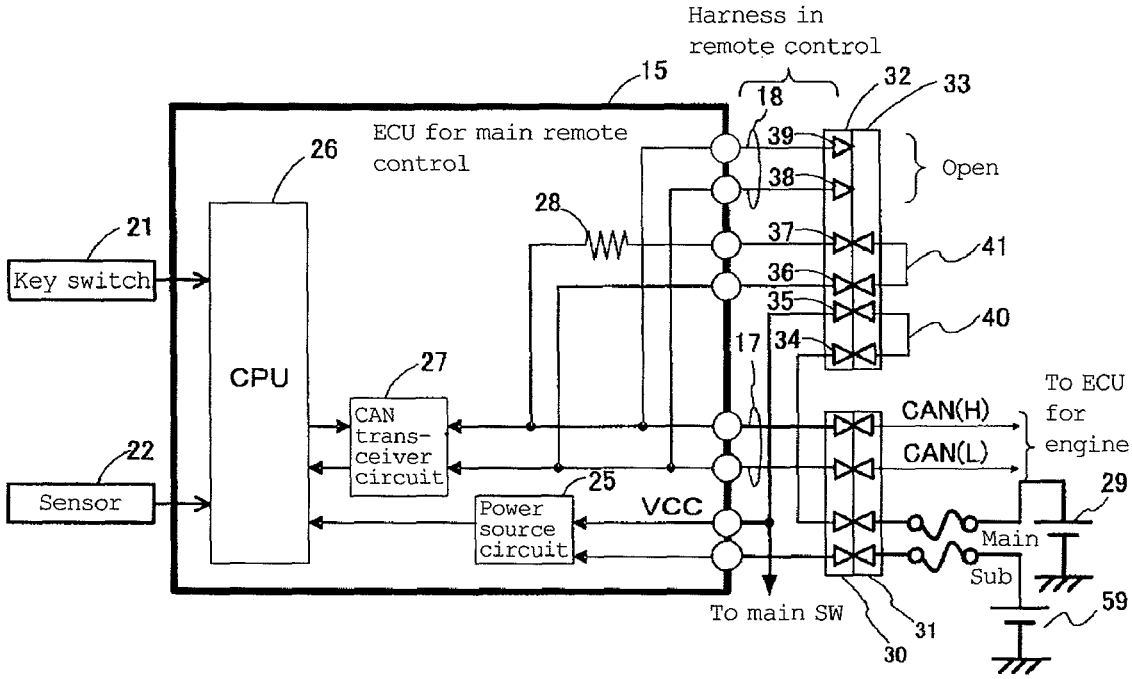
[Fig. 4]

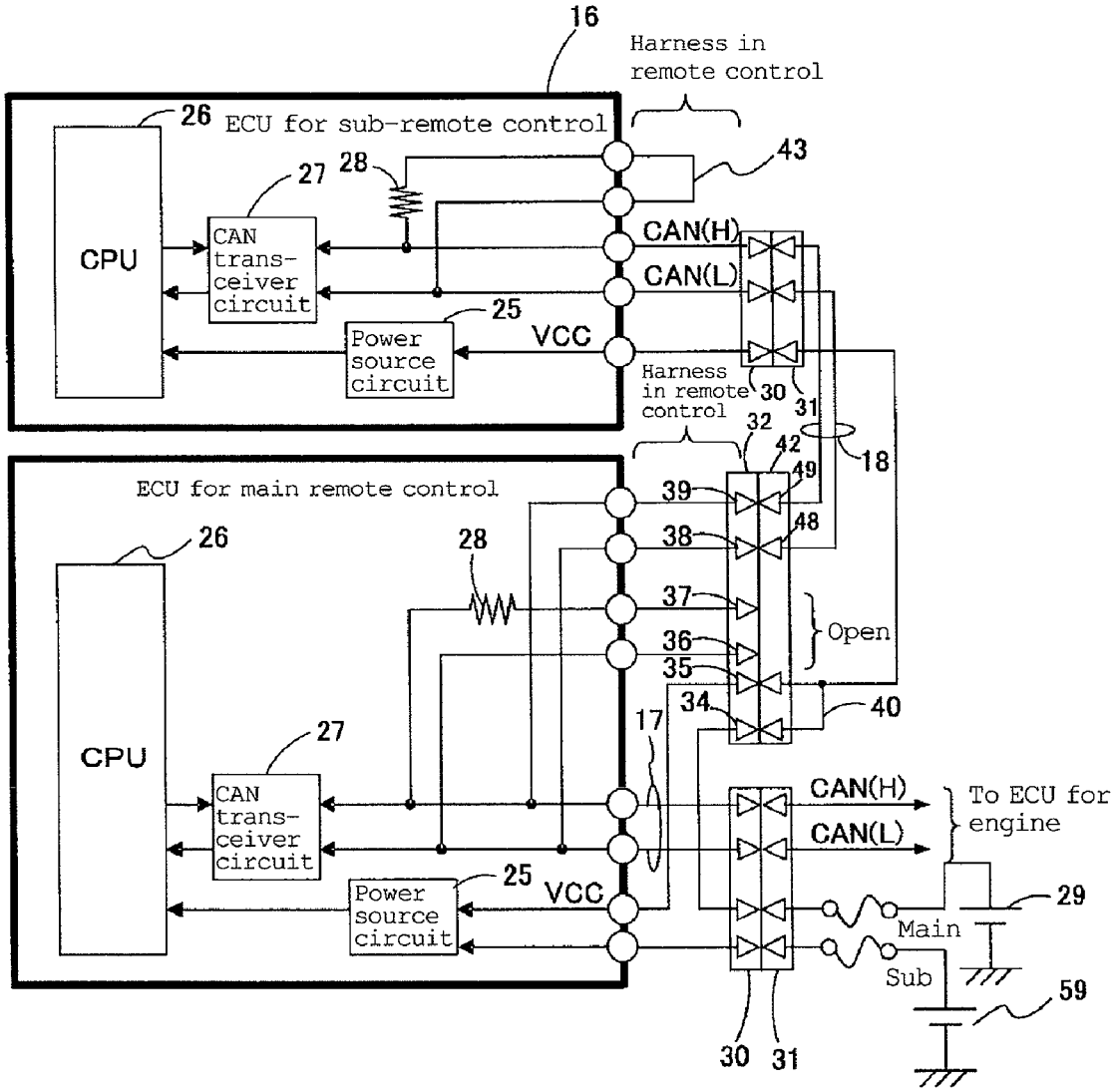
[Fig. 5]

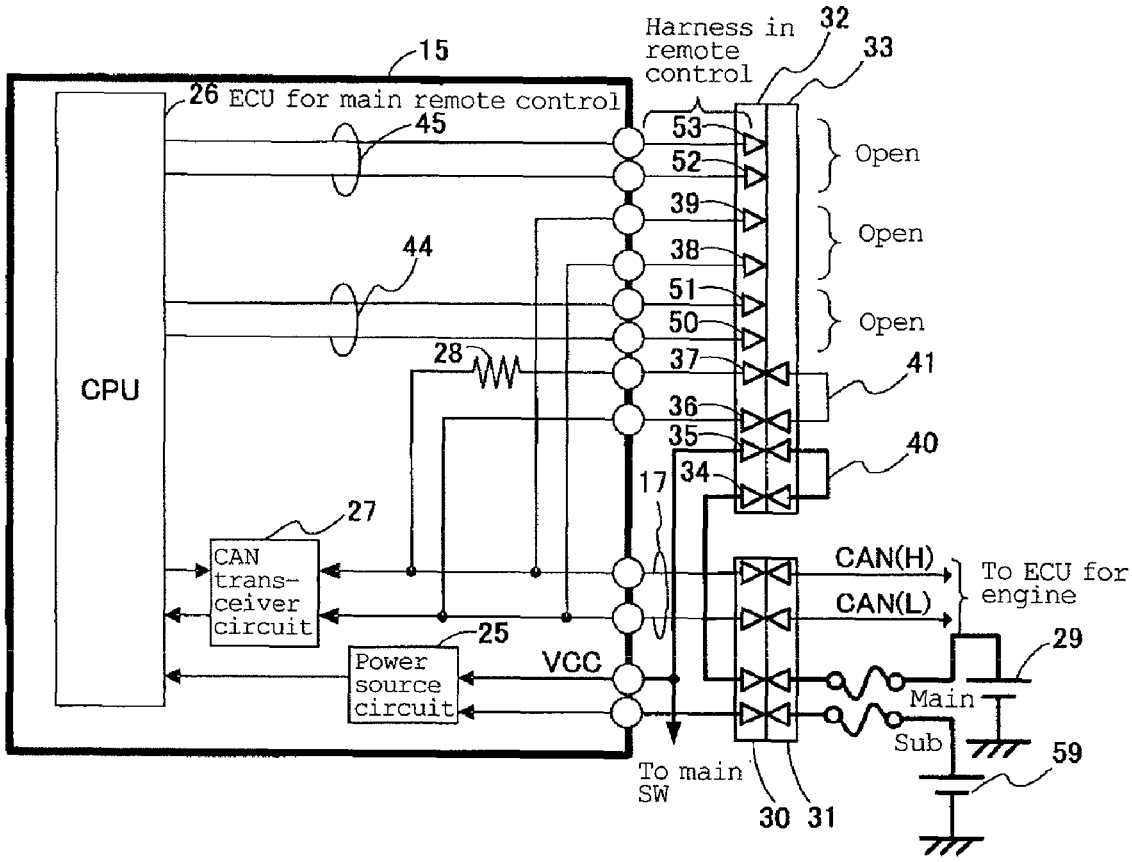
[Fig. 6]

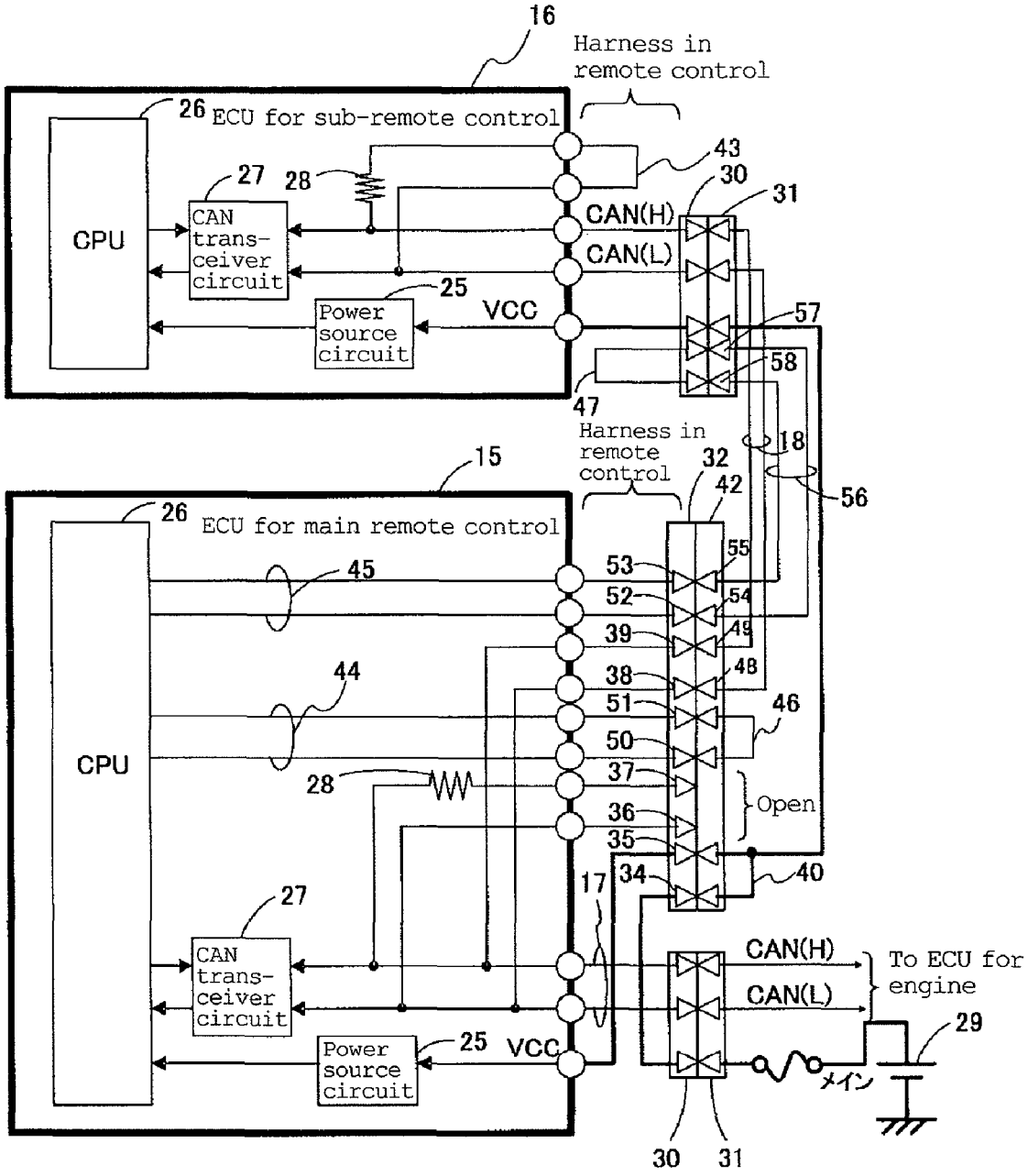
[Fig. 7]

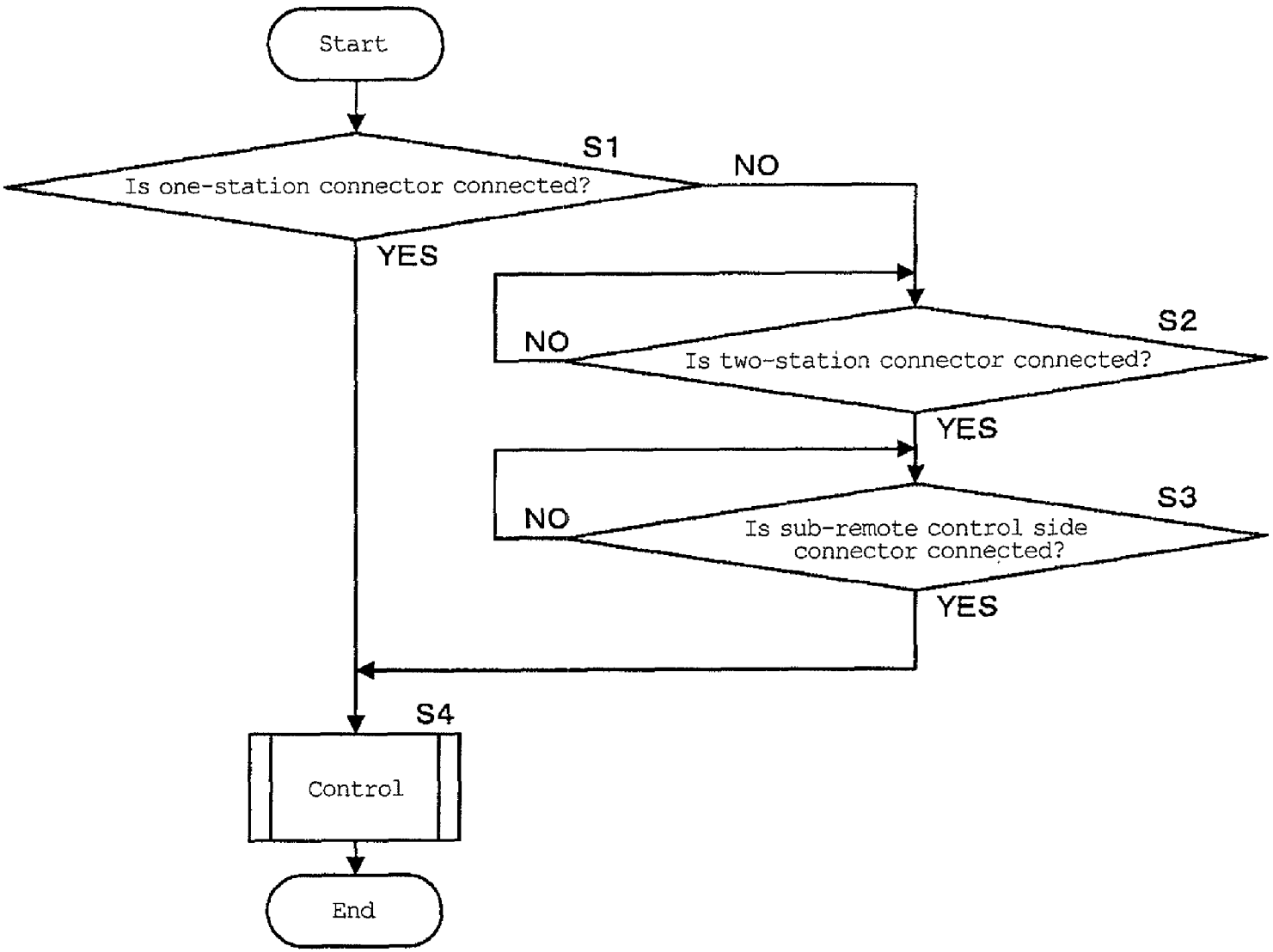
[Fig. 8]

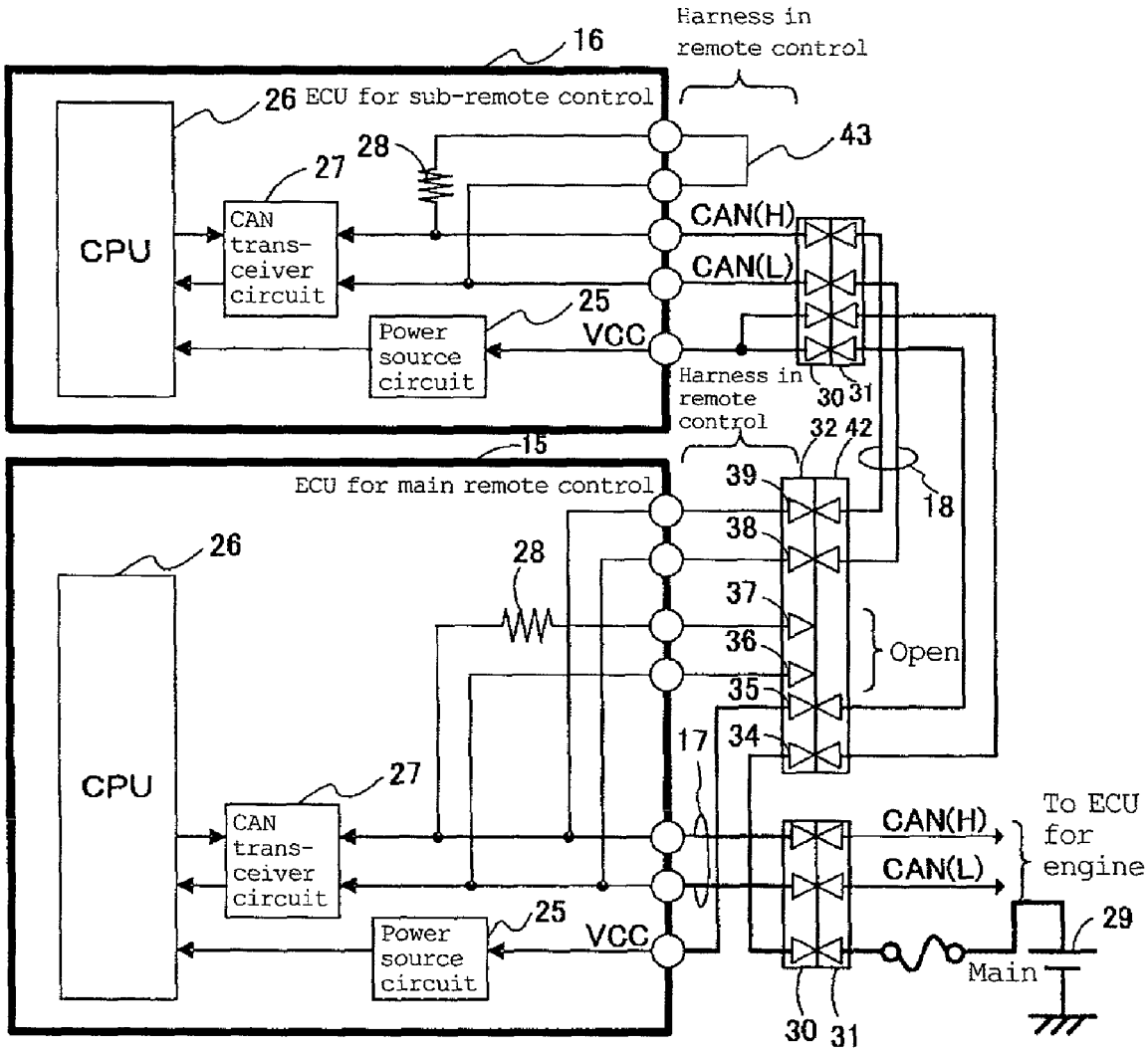
[Fig. 9]

ELECTRONIC CONTROL DEVICE FOR REMOTE CONTROL AND TELEOPERATION SYSTEM USING SAME

PRIORITY INFORMATION

This application is based on and claims priority to Japanese Patent Application No. 2006-141630, filed May 22, 2006, the entire contents of which is hereby expressly incorporated by reference herein.

BACKGROUND OF THE INVENTION

1. Field of the Invention

The present invention relates to an electronic control device for a remote control (remote operation device) and a teleoperation system using the electronic control device. More specifically, the present invention relates to an electronic control unit (ECU) for a remote control and a teleoperation system using the ECU for use in a transport vehicle such as a boat.

2. Description of the Related Art

As local area network (LAN) for use in a transport vehicle such as a boat, a controller area network (CAN) in compliance with ISO 11898 is known. In a boat, for example, an ECU for a remote control in the cockpit and an ECU for an engine in the outboard motor are connected by a CAN cable as a two-line communication cable so that the outboard motor can be electrically and remotely controlled from the cockpit. See e.g., Japanese Patent Applications JP-A-2003-127985, JP-A-2003-146292, JP-A-2003-304265, JP-A-2004-217180, JP-A-2005-254849. JP Patent Application 2005-294352 (unpublished prior application).

A CAN cable has a high signal line and a low signal line. When a "0" signal is transmitted, the ECU sets the high signal line at a high level (3.5 V, for example) and the low signal line at a low level (21.5 V, for example). When a "1" signal is transmitted, the ECU sets the high signal line at a low level and the low signal line at a high level. The ECU detects the potential difference between the high signal line and the low signal line to determine whether the received signal is "0" or "1".

When two ECUs are connected to each other as described above, there can occur a case where a signal is reflected at an end of the CAN cable and its waveform is distorted to cause a sudden communication failure during cruising. To prevent it, termination resistances (which are referred to also as "terminators") are connected to both ends of the CAN. More specifically, each termination resistance is connected between the high signal line and the low signal line of the CAN cable.

When the construction of such a CAN is left to the user of the boat, the user can forget to connect the termination resistances. However, when the manufacturer of the boat constructs the CAN, there is almost no possibility of it.

Some boats have another cockpit above the cockpit. The lower, primary cockpit is called main station, and the other, upper cockpit is called sub-station. When there are two cockpits, each cockpit has an ECU for a remote control so that the outboard motor can be remotely operated from both the cockpits. In this case, the CAN cables are connected not in a star configuration but in a bus configuration. More specifically, the ECU for a remote control in the main station and the ECU for an engine are connected by a CAN cable, and the ECU for a remote control in the main station and the ECU for a remote control in the sub-station are connected by another CAN cable. In this case, termination resistances are connected, one each, to the ECU for an engine and the ECU for a remote control in the sub-station, but there is no need to connect a termination resistance to the ECU for a remote control in the main station.

In a two-station system having two ECUs for a remote control, when the sub-station has a failure, the user switches by himself or herself to a one-station system which uses only the ECU for a remote control in the main station so that the boat control in the main station cannot be adversely affected. In this case, however, it is often forgotten to connect a termination resistance to the ECU for a remote control in the main station. When no termination resistance is connected, the ECU for a remote control in the main station can operate but may malfunction as described before.

SUMMARY OF THE INVENTION

To solve the problem, the present applicant has filed an application for a system which disconnects the ECU for a remote control in the sub-station and connects a termination resistance to the ECU for a remote control in the main station by means of an electromagnetic relay when the sub-station has a failure (see JP Patent Application 2005-294352, unpublished application). The present invention is intended to realize the same function with a simple configuration without using an electromagnetic relay.

Accordingly, an object of one aspect of the present invention is to provide an electronic control device for a remote control which does not operate unless a necessary termination resistance is connected thereto and a teleoperation system using the electronic control device.

Another object of one aspect of the present invention is to provide an electronic control device for a remote control in which the termination resistance of an electronic control device for a main remote control is disconnected and the termination resistance of an electronic control device for a sub-remote control is connected when an electronic control device for a sub-remote control is used, and a teleoperation system using the electronic control device.

An electronic control device for a remote control according to some aspects of the present invention is connectable to an electronic control device for an engine for controlling the engine via a first two-line communication cable, and has a central processing unit, a transceiver circuit, a termination resistance, and a first connector. The transceiver circuit is connected to the central processing unit, and connected to the electronic control device for the engine via the first two-line communication cable. The termination resistance has a first terminal connected to one of signal lines of the first two-line communication cable. The first connector includes first to fourth external terminals. The first external terminal is connected to a power wire to be connected to an external power source. The second external terminal is connected to a power wire connected to the central processing unit. The third external terminal is connected to a second terminal of the termination resistance. The fourth external terminal is connected to the other signal line of the first two-line communication cable.

In one aspect of the present invention, the electronic control device for a remote control further includes a second connector to be coupled to the first connector. The second connector includes first and second jumper lines. The first jumper line is connected between the first external terminal and the second external terminal. The second jumper line is connected between the third external terminal and the fourth external terminal. Therefore, when the second connector is connected to the first connector, the termination resistance is connected and power is switched on. When the first and second connectors are disconnected and the termination resistance is not connected, and power is not switched on. As a result, the electronic control device for a remote control does not operate unless a necessary termination resistance is connected thereto.

In another aspect of the present invention, the first connector further includes fifth and sixth external terminals. The fifth external terminal is connected to one of signal lines of the first two-line communication cable. The sixth external terminal is connected to the other signal line of the first two-line communication cable. The electronic control device for a remote control further includes a third connector to be coupled to the first connector. The third connector includes a first jumper line, a seventh external terminal, and an eighth external terminal. The first jumper line is connected between the first external terminal and the second external terminal. The seventh external terminal is connected to one of signal lines of a second two-line communication cable to be connected to an electronic control device for another remote control. The eighth external terminal is connected to the other signal line of the second two-line communication cable. Therefore, when the third connector is connected to the first connector, the termination resistance is not connected but power is switched on. Also, the electronic control device for a remote control is connected to the electronic control device for another remote control via the second two-line communication cable.

A teleoperation system according to embodiments has the above electronic control device for an engine, and the above electronic control device for a main remote control, and optionally has the above electronic control device for a sub-remote control.

A boat according to embodiments of has the above teleoperation system.

BRIEF DESCRIPTION OF THE DRAWINGS

FIG. 1 is a side view of a boat provided with a teleoperation system according to a first embodiment.

FIG. 2 is a function block diagram illustrating the configuration of the teleoperation system shown in FIG. 1.

FIG. 3 is a function block diagram illustrating the configuration of an ECU for an engine and so on shown in FIG. 2.

FIG. 4 is a function block diagram illustrating the configuration of an ECU for a main remote control and so on shown in FIG. 2 and the manner of connection thereof in a one-station system.

FIG. 5 is a function block diagram illustrating the configuration of ECUs for a main remote control and a sub-remote control and so on shown in FIG. 2 and the manner of connection thereof in a two-station system.

FIG. 6 is a function block diagram illustrating the configuration of an ECU for a main remote control and so on and the manner of connection thereof in a one-station system in a second embodiment.

FIG. 7 is a function block diagram illustrating the configuration of ECUs for the main remote control and a sub-remote control and so on and the manner of connection thereof in a two-station system in the second embodiment.

FIG. 8 is a flowchart illustrating an operation of the ECU for the main remote control shown in FIG. 6 and FIG. 7.

FIG. 9 is a function block diagram illustrating the configuration of ECUs for a main remote control and a sub-remote control and so on and the manner of connection thereof in a two-station system in a third embodiment.

DETAILED DESCRIPTION OF THE PREFERRED EMBODIMENTS

Description is hereinafter made of embodiments in detail with reference to the drawings. The same or corresponding components are denoted in all the drawings by the same reference numerals and their description is not repeated.

Referring to FIG. 1, a teleoperation system according to a first embodiment is mounted on a boat. A hull 10 has a stern, to which an outboard motor 11 is attached. A main station 12 as a primary cockpit is located in the middle of the hull 10, and a sub-station 13 as a subordinate cockpit is located above the main station 12. An ECU 14 for an engine is located in the outboard motor 11. An ECU 15 for a main remote control is located in the main station 12, and an ECU 16 for a sub-remote control is located in the sub-station 13. The ECU 16 for a sub-remote control is optional and may not be installed.

Referring to FIG. 2, the teleoperation system 20 according to this embodiment has an ECU 14 for an engine, an ECU 15 for a main remote control, and an ECU 16 for a sub-remote control. The ECU 14 for an engine is connected via a CAN cable 17 to the ECU 15 for a main remote control, which is connected via a CAN cable 18 to the ECU 16 for a sub-remote control. Therefore, the outboard motor 11 can be operated remotely from the sub-station 13 as well as from the main station 12.

The ECU 15 for a main remote control transmits an engine start or stop signal to the ECU 14 for an engine via the CAN cable 17 in response to an operation of various key switches 21. The ECU 15 for a main remote control also detects the shift position (forward, reverse, neutral, etc.), the throttle target opening, and the steering target angle based on output signals from various sensors 22 attached to a shift lever, a throttle lever, a steering wheel and so on, and transmits the signals to the ECU 14 for an engine via the CAN cable 17. There can be more sensors installed to detect aspects of the boat which can used to affect or control the operation of the outboard motor 11. The ECU 16 for a sub-remote control functions in the same manner.

The ECU 14 for an engine detects the throttle opening and rotational speed of the engine, the shift position, and the steering angle based on output signals from various sensors 23 attached to the outboard motor 11, and transmits the signals to the ECU 15 for a main remote control via the CAN cable 17 and also to the ECU 16 for a sub-remote control via the CAN cable 18. The ECU 14 for an engine also drives various actuators 24 attached to the outboard motor 11 to change the throttle opening, the shift position, and the steering angle.

Referring to FIG. 3, the ECU 14 for an engine includes a power source circuit 25, a central processing unit (CPU) 26, a CAN transceiver circuit 27, and a termination resistance 28. The power source circuit 25 receives power supply from a battery 29, and supplies a prescribed voltage (3.5 V for example) to the CPU 26, the CAN transceiver circuit 27, and so on. The CAN transceiver circuit 27 is connected to the CPU 26 and connected to the ECU 15 for a main remote control via the CAN cable 17. The CAN cable 17 includes a high signal line CAN(H) and a low signal line CAN(L). The termination resistance 28 has a first terminal connected to the high signal line CAN(H) and a second terminal connected to the low signal line CAN(L). The CAN cable 17 and a power wire VCC form a harness, and can be selectively connected and disconnected via connectors 30 and 31.

The ECU 15 for a main remote control and the ECU 16 for a sub-remote control are substantially the same in configuration. The ECU 15 for a main remote control has a connector 32 as shown in FIG. 4 and FIG. 5, though. The connector 32 has a casing, and external terminals 34 to 39 buried in the casing. The power wire VCC is divided in the harness, and a first part of the power wire VCC to be connected to the battery 29 outside is connected to the external terminal 34. A second part of the power wire VCC connected to the power source circuit 25 inside is connected to the external terminal 35. The low signal line CAN(L) is connected to the external terminal 36. The first terminal and the second terminal of the termination resistance 28 are connected to the high signal line CAN (H) and the external terminal 37, respectively. The low signal line CAN(L) is connected to the external terminal 38, and the high signal line CAN(H) is connected to the external terminal 39.

In a one-station system, the ECU 15 for a main remote control is connected as shown in FIG. 4. In a two-station system, the ECU 15 for a main remote control and the ECU 16 for a sub-remote control are connected as shown in FIG. 5.

More specifically, in one-station system, a one-station connector 33 is connected to the connector 32 as shown in FIG. 4. The connector 33, which is coupled to the connector 32, has a jumper line 40 connected between the external terminal 34 and the external terminal 35, and a jumper line 41 connected between the external terminal 36 and the external terminal 37. Therefore, the external terminals 34 and 35 are short-circuited with each other by the jumper line 40 and connected to the power wire VCC. The external terminals 36 and 37 are short-circuited with each other by the jumper line 41, and the termination resistance 28 is connected between the high signal line CAN(H) and the low signal line CAN(L). The external terminals 38 and 39 are not connected to anything and left open.

As described above, in a one-station system, when the user connects the one-station connector 33 to the connector 32, the ECU 15 for a main remote control is switched on and the termination resistance 28 is connected. Therefore, if the user forgets to connect the one-station connector 33 to the connector 32, the ECU 15 for a main remote control does not operate since no power is supplied to it.

In a two-station system, a two-station connector 42 is connected to the connector 32 as shown in FIG. 5. The connector 42, which is coupled to the connector 32, has a jumper line 40 connected between the external terminal 34 and the external terminal 35, and relay terminals 48 and 49 connected to the CAN cable 18. The power wire VCC is short-circuited by the jumper line 40 and connected to the ECU 16 for a sub-remote control. The external terminals 38 and 39 are connected to the relay terminals 48 and 49, respectively, and to the ECU 16 for a sub-remote control via the CAN cable 18. The external terminals 36 and 37 are not connected to anything and left open. In the ECU 16 for a sub-remote control, since a jumper line 43 is constantly connected in the harness, the termination resistance 28 is constantly connected between the high signal line CAN(H) and the low signal line CAN(L).

As described above, according to the first embodiment, when the one-station connector 33 is connected in advance of the shipment of the ECU 15 for a main remote control, the work of setting it up into a one-station system, which is employed widely, can be facilitated. Also, it can be set up into a two-station system by simply removing the one-station connector 33 and connecting the two-station connector 42 instead. In addition, even when a failure occurs in the sub-station 13 during cruising as a two-station system, all that have to be done is to remove the two-station connector 42 and connect the one-station connector 33 instead. In this case, the user can perform the switching quickly and reliably without thinking of the connection of the termination resistance 28.

When the boat has a sub battery 59 in addition to the main battery 29 as shown in FIGS. 4 to 6, it is preferred that the jumper line 40 does not connect and short-circuit a sub power wire connected to the sub battery 59 and short-circuits only a main power wire VCC connected to the main battery 29. This is because the one-station connector 33 can be decreased in size. In this case, power is supplied to a main switch only through the main power wire VCC. Other structure is possible. For example, there can be more batteries other than the main battery 29 and the sub battery 59.]

In the first embodiment described above, the ECU 16 for a sub-remote control does not operate even in a two-station system when the connector 31 on the side of the ECU 16 for a sub-remote control is not connected but the ECU 15 for a main remote control operates with the termination resistance 28 disconnected. To solve the problem, a pair of connection distinguishing signal lines 44 for distinguishing the connection/disconnection of the two-station connector 42 and a pair of connection distinguishing signal lines 45 for distinguishing the connection/disconnection of the ECU 16 for a sub-remote control are provided in the ECU 15 for a main remote control as shown in FIG. 6 and FIG. 7 in the second embodiment.

In a one-station system, the one-station connector 33 is connected as shown in FIG. 6. The connector 32 further includes external terminals 50 to 53. The external terminals 50 and 51 are connected to the connection distinguishing signal lines 44, respectively, and the external terminals 52 and 53 are connected to the connection distinguishing signal lines 45, respectively. In this case, all the connection distinguishing signal lines 44 and 45 are left open.

In a two-station system, a two-station connector 42 is connected as shown in FIG. 7. The external terminals 50 and 51 are connected to the connection distinguishing signal lines 44, respectively, and the external terminals 52 and 53 are connected to the connection distinguishing signal lines 45, respectively. In this case, the connection distinguishing signal lines 44 are short-circuited by a jumper line 46. The connector 42 also includes relay terminals 54 and 55. The relay terminals 54 and 55 are connected to relay terminals 57 and 58 of the connector 31 on the side of the ECU 16 for a sub-remote control, respectively, via external connection distinguishing signal lines 56. Therefore, the connection distinguishing signal lines 45 and 56 are short-circuited by a jumper line 47.

Referring to FIG. 8, when power is switched on with the one-station connector 33 connected, since the CPU 26 does not detect a short-circuit of the connection distinguishing signal lines 44, it recognizes the connection of the one-station connector 33 (YES in S1). Then, control of the CAN transceiver circuit 27 is started as usual in the same manner as in the first embodiment (S4).

When power is switched on with the two-station connector 42 connected, since the CPU 26 detects a short-circuit of the connection distinguishing signal lines 44, it recognizes the connection of the two-station connector 42 (YES in S2). In this case, if the connector 31 on the side of the ECU 16 for a sub-remote control is also connected, since the CPU 26 also detects a short-circuit of the connection distinguishing signal lines 45, it recognizes the connection of the connector 31 on the side of the ECU 16 for a sub-remote control (YES in S3). Then, control of the CAN transceiver circuit 27 is started as usual in the same manner as above (S4).

As described above, according to the second embodiment, the connection of the two-station connector 42 is distinguished with the connection distinguishing signal lines 44, and the connection of the connector 31 on the ECU 16 for a sub-remote control side is distinguished with the connection distinguishing signal lines 45. Thus, the ECU 15 for a main remote control does not operate unless both the connectors 42 and 31 are connected. Therefore, the ECU 15 for a main remote control is prevented from operating with the termination resistance 28 disconnected.

In a third embodiment, two power wires VCC extended from the two-station connector 42 are connected to the connector 31 on the side of the ECU 16 for a sub-remote control to short-circuit the power wires VCC on the side of the corresponding connector 30 as shown in FIG. 9 in order to solve the same problem as described in the second embodiment.

According to the third embodiment, the ECU 15 for a main remote control does not operate unless both the connectors 42 and 31 are connected. Therefore, the ECU 15 for a main remote control is prevented from operating with the termination resistance 28 disconnected. In addition, the ECU 15 for a main remote control does not operate when the connector 31 on the ECU 16 for a sub-remote control side is disconnected after the power has been switched on.

Although only one of the terminals of the termination resistance is connected to an external terminal of a connector in the first to third embodiments, both the terminals can be respectively connected to two external terminals of a connector. In this case, when the termination resistance is disconnected, both the terminals thereof are disconnected from the CAN cable. Also, the number of the stations is not limited to one or two but can be three or more. When the number of the stations is three or more, it is only necessary that one or more ECU for a remote control is additionally connected between the ECU for a main remote control and the ECU for a sub-remote control. The additional ECUs for a remote control can be substantially the same in configuration as the ECU for a main remote control. In addition, the power source circuit is not essential in the present invention. An external power source or the like can directly supply power to the CPU and so on.

Although this invention has been disclosed in the context of certain preferred embodiments and examples, it will be understood by those skilled in the art that the present invention extends beyond the specifically disclosed embodiments to other alternative embodiments and/or uses of the invention and obvious modifications and equivalents thereof. In addition, while a number of variations of the invention have been shown and described in detail, other modifications, which are within the scope of this invention, will be readily apparent to those of skill in the art based upon this disclosure. It is also contemplated that various combinations or subcombinations of the specific features and aspects of the embodiments may be made and still fall within the scope of the invention. Accordingly, it should be understood that various features and aspects of the disclosed embodiments can be combine with or substituted for one another in order to form varying modes of the disclosed invention. Thus, it is intended that the scope of the present invention herein disclosed should not be limited by the particular disclosed embodiments described above, but should be determined only by a fair reading of the claims that follow

What is claimed is:

1. An electronic control device for a remote control connectable to an electronic control device for an engine for controlling the engine via a first two-line communication cable, comprising:

a central processing unit;

a transceiver circuit configured to be connected to the central processing unit and to be connected to the electronic control device for an engine via the first two-line communication cable;

a termination resistance comprising a first terminal connected to one of signal lines of the first two-line communication cable; and a first connector, wherein the first connector includes:

a first external terminal connected to a power wire to be connected to an external power source;

a second external terminal connected to a power wire connected to the central processing unit;

a third external terminal connected to a second terminal of the termination resistance; and a fourth external terminal connected to the other signal line of the first two-line communication cable.

2. The electronic control device for a remote control according to claim 1, further comprising:

a second connector configured to be coupled to the first connector, the second connector comprising:

a first jumper line connected between the first external terminal and the second external terminal; and a second jumper line connected between the third external terminal and the fourth external terminal.

3. The electronic control device for a remote control according to claim 1, wherein the first connector further comprises:

a fifth external terminal connected to the one of signal lines of the first two-line communication cable; and a sixth external terminal connected to the other signal line of the first two-line communication cable, wherein the electronic control device for a remote control further comprises:

a third connector configured to be coupled to the first connector, the third connector comprising:

a first jumper line connected between the first external terminal and the second external terminal;

a seventh external terminal connected to one of signal lines of a second two-line communication cable to be connected to an electronic control device for another remote controlling device; and an eighth external terminal connected to the other signal line of the second two-line communication cable.

4. The electronic control device for a remote control according to claim 2, further comprising:

a pair of first connection distinguishing signal lines connected to the central processing unit, wherein the first connector further comprises:

a ninth external terminal connected to one of the first connection distinguishing signal lines; and a tenth external terminal connected to the other of the first connection distinguishing signal lines, wherein the central processing unit starts control of the transceiver circuit when not detecting a short-circuit between the first connection distinguishing signal lines.

5. The electronic control device for a remote control according to claim 3, further comprising:

a pair of first connection distinguishing signal lines connected to the central processing unit; and a pair of second connection distinguishing signal lines connected to the central processing unit, wherein the first connector further comprises:

a ninth external terminal connected to one of the first connection distinguishing signal lines;

a tenth external terminal connected to the other of the first connection distinguishing signal lines;

an eleventh external terminal connected to one of the second connection distinguishing signal lines; and a twelfth external terminal connected to the other of the second connection distinguishing signal lines, wherein the central processing unit starts control of the transceiver circuit when detecting a short-circuit between the first connection distinguishing signal lines and a short-circuit between the second connection distinguishing signal lines.

6. A teleoperation system comprising:

an electronic control device for an engine configured to control an engine; and an electronic control device for a remote control connected to the electronic control device for an engine via a two-line communication cable, wherein the electronic control device for a remote control comprises:

a central processing unit;

a transceiver circuit connected to the central processing unit and connected to the electronic control device for an engine via the two-line communication cable;

a termination resistance having a first terminal connected to one of signal lines of the two-line communication cable;

a first connector; and a second connector coupled to the first connector, the first connector including:

a first external terminal connected to a power wire connected to an external power source;

a second external terminal connected to a power wire connected to the central processing unit;

a third external terminal connected to a second terminal of the termination resistance; and a fourth external terminal connected to the other signal line of the two-line communication cable, the second connector including:

a first jumper line connected between the first external terminal and the second external terminal; and a second jumper line connected between the third external terminal and the fourth external terminal.

7. The teleoperation system of claim 6 in combination with a boat.

8. A teleoperation system comprising:

an electronic control device for an engine configured to control an engine;

an electronic control device for a main remote control connected to the electronic control device for an engine via a first two-line communication cable; and an electronic control device for a sub-remote control connected to the electronic control device for a main remote control via a second two-line communication cable, wherein the electronic control device for a main remote control comprises:

a central processing unit;

a transceiver circuit connected to the central processing unit and connected to the electronic control device for an engine via the first two-line communication cable;

a termination resistance having a first terminal connected to one of signal lines of the first two-line communication cable;

a first connector; and a second connector coupled to the first connector, the first connector comprising:

a first external terminal connected to a power wire connected to an external power source;

a second external terminal connected to a power wire connected to the central processing unit;

a third external terminal connected to a second terminal of the termination resistance;

a fourth external terminal connected to the other signal line of the first two-line communication cable;

a fifth external terminal connected to the one of signal lines of the first two-line communication cable; and a sixth external terminal connected to the other signal line of the first two-line communication cable, the second connector including:

a jumper line connected between the first external terminal and the second external terminal;

a first relay terminal connected to one of signal lines of the second two-line communication cable; and an eighth relay terminal connected to the other signal line of the second two-line communication cable.

9. The teleoperation system of claim 8 in combination with a boat.

10. A teleoperation system comprising:

an electronic control device for an engine for controlling an engine; and an electronic control device for a remote control connected to the electronic control device for an engine via a two-line communication cable, wherein the electronic control device for a remote control comprises:

a central processing unit;

a transceiver circuit connected to the central processing unit and connected to the electronic control device for an engine via the two-line communication cable;

a termination resistance having a first terminal connected to one of signal lines of the two-line communication cable;

a pair of connection distinguishing signal lines connected to the central processing unit;

a first connector; and a second connector coupled to the first connector, the first connector comprising:

a first external terminal connected to a power wire connected to an external power source;

a second external terminal connected to a power wire connected to the central processing unit;

a third external terminal connected to a second terminal of the termination resistance;

a fourth external terminal connected to the other signal line of the first two-line communication cable;

a fifth external terminal connected to one of the first connection distinguishing signal lines; and a sixth external terminal connected to the other of the first connection distinguishing signal lines, the second connector comprising:

a first jumper line connected between the first external terminal and the second external terminal; and a second jumper line connected between the third external terminal and the fourth external terminal, wherein the central processing unit starts control of the transceiver circuit when detecting a short-circuit between the connection distinguishing signal lines.

11. The teleoperation system of claim 10 in combination with a boat.

12. A teleoperation system comprising:

an electronic control device for an engine for controlling an engine;

an electronic control device for a main remote control connected to the electronic control device for an engine via a first two-line communication cable; and an electronic control device for a sub-remote control connected to the electronic control device for a main remote control via a second two-line communication cable, wherein the electronic control device for a main remote control comprises:

a central processing unit;

a transceiver circuit connected to the central processing unit and connected to the electronic control device for an engine via the first two-line communication cable;

a termination resistance having a first terminal connected to one of signal lines of the first two-line communication cable;

a pair of first connection distinguishing signal lines connected to the central processing unit;

a pair of second connection distinguishing signal lines connected to the central processing unit;

a first connector; and a second connector coupled to the first connector, the first connector comprising:

a first external terminal connected to a power wire connected to an external power source;

a second external terminal connected to a power wire connected to the central processing unit;

a third external terminal connected to a second terminal of the termination resistance;

a fourth external terminal connected to the other signal line of the first two-line communication cable;

a fifth external terminal connected to the one of signal lines of the first two-line communication cable; and a sixth external terminal connected to the other signal line of the first two-line communication cable;

a seventh external terminal connected to one of the first connection distinguishing signal lines; and an eighth external terminal connected to the other of the first connection distinguishing signal lines;

a ninth external terminal connected to one of the second connection distinguishing signal lines; and a tenth external terminal connected to the other of the second connection distinguishing signal lines, the second connector comprising:

a first jumper line connected between the first external terminal and the second external terminal;

a second jumper line connected between the third external terminal and the fourth external terminal a first relay terminal connected to one of signal lines of the second two-line communication cable; and a second relay terminal connected to the other signal line of the second two-line communication cable;

a third relay terminal connected to one of a pair of external connection distinguishing signal lines; and a fourth relay terminal connected to the other of the external connection distinguishing signal lines, wherein the electronic control device for a sub-remote control includes:

a third connector; and a fourth connector coupled to the third connector, the third connector including:

a fifth relay terminal connected to the one of the external connection distinguishing signal lines; and a sixth relay terminal connected to the other of the external connection distinguishing signal lines, the fourth connector comprising:

a third jumper line connected between the fifth external terminal and the sixth external terminal, wherein the central processing unit starts control of the transceiver circuit when detecting a short-circuit between the first connection distinguishing signal lines and a short-circuit between the second connection distinguishing signal lines.

13. The teleoperation system of claim 12 in combination with a boat.

* * * * *